United States Patent [19]

Strangward

[11] Patent Number: 4,510,786

[45] Date of Patent: Apr. 16, 1985

[54] METHOD AND APPARATUS OF MAKING DOUBLE REVERSE CORRUGATED MATERIAL

[75] Inventor: William J. Strangward, Rocky River, Ohio

[73] Assignee: The Langenau Manufacturing Company, Cleveland, Ohio

[21] Appl. No.: 496,088

[22] Filed: May 19, 1983

[51] Int. Cl.[3] ..... B21D 28/10; B21D 45/08

[52] U.S. Cl. ..... 72/326; 72/328; 83/140; 83/136; 83/132; 29/6.2

[58] Field of Search ..... 72/326, 332, 328, 427; 83/140, 136, 132, 129; 29/163.5, 6.1, 6.2

[56] References Cited

U.S. PATENT DOCUMENTS

| | | | |
|---|---|---|---|
| 493,791 | 3/1893 | Schurig | 72/326 |
| 1,925,034 | 8/1933 | Fitzgerald | 83/140 |
| 2,350,004 | 5/1944 | Whistler et al. | 72/326 |
| 2,828,792 | 4/1958 | Hill | 29/6.2 |
| 3,162,925 | 12/1964 | Felsenthal | 29/163.5 R |
| 3,376,684 | 4/1968 | Cole et al. | 428/119 |
| 3,488,987 | 1/1970 | Stoeckli | 72/328 |
| 3,803,894 | 4/1974 | Bustin | 72/332 |

FOREIGN PATENT DOCUMENTS

| | | | |
|---|---|---|---|
| 839339 | 9/1952 | Fed. Rep. of Germany | 72/326 |

*Primary Examiner*—Daniel C. Crane

*Attorney, Agent, or Firm*—Pearne, Gordon, Sessions, McCoy, Granger & Tilberry

[57] ABSTRACT

A method of making double reverse corrugated material includes feeding the material between an upper die and a lower die. Each of the dies have laterally spaced projections and a stripper positioned in the spaces between the projections of the die. One die is moved toward the other die to form the corrugations in the material. One die is moved away from the other die while both strippers and the other die are maintained substantially fixed with respect to each other. The stripper associated with the moving die is then moved with respect to the other die and the stripper associated with the other die is then moved with respect o the other die to strip the formed double reverse corrugated material from the dies. The formed material is then moved out from between the dies.

10 Claims, 11 Drawing Figures

METHOD AND APPARATUS OF MAKING DOUBLE REVERSE CORRUGATED MATERIAL

BACKGROUND OF THE INVENTION

1. Field of the Invention

This invention relates to metal forming, and particularly to a method for forming a material which has corrugations in two directions.

2. Description of the Prior Art

U.S. Pat. No. 3,376,684, issued to D. W. Cole et al., discloses a double reverse corrugated material and a method for making this material. As described in the Cole patent, the material is an open, truss form or reticulated structural material having two basic and integrally connected elements—strut-like members which extend between upper and lower crest-bent nodals, and cripples which are members extending from a median fold position substantially on the median plane of the material to the crest-bent nodals. The resulting material provides unique structural advantages as use for core material or as fencing material. As described in the Cole patent, this double reverse corrugated material differs from well known conventional corrugated material because alternate corrugations have been reversed so as to halve the pitch span of the resultant structure without alteration of height, depth or overall area.

The aforementioned Cole patent also describes a method of manufacture of a double reverse corrugated material which comprises three basic steps. First, flat metal stock sheet is provided with longitudinally cut, slit, or chemically etched slots. Generally, such slots would be pierced through the sheet by means of a piercing die. The slots are symetrically staggered, offset, or laterally displaced, row from row and column from column. Second, a slotted sheet stock undergoes an initial strike in a conventional sheet metal brake in which the area between the slots is alternately displaced upward and downward to form the corrugations. Third and last, the double reverse corrugated material is formed by restriking the "initial strike" corrugation. The restrike is accomplished by a set of matched dies having flattened portions extending outwardly from a median plane and cup-like cavities extending inwardly therefrom. The initial strike corrugated material is fed into the restrike area by suitable feed mechanisms. While the resulting double reverse corrugating material is extremely valuable, the three step process described in the aforementioned Cole patent is time-consuming and makes the resulting material expensive to produce.

Since the issuance of the aforementioned Cole patent, the method of manufacture of double reverse corrugated material has been simplified somewhat. However, until now, it has not been possible to form the material in a single automatic operation. One problem with forming this material by a single strike has been removing the corrugated material from the forming die. Any attempt to forcibly remove the material during the forming process can result in the material being deformed as it is removed from the die. As a result, it has heretofore been necessary to undertake some preforming step prior to the final strike of the material, or to meticulously strip the material manually from the forming dies after each single strike.

SUMMARY OF THE INVENTION

The present invention overcomes the problems of the prior art and provides a method of manufacture of double reverse corrugated material in which the material can be automatically formed from flat sheet metal stock in a single operation. The method of the present invention allows this material to be economically and quickly formed by a single operator using a single press brake.

In accordance with the present invention, the double reverse corrugated material is automatically stripped from the die in such a manner that the material is not deformed but retains the shape imparted to it by the forming die. Manual operations previously necessary to remove the formed material from the die without deforming the material are eliminated.

These and other advantages are accomplished by the present invention of a method of making double reverse corrugated material which comprises the steps of feeding sheet material between two dies. Each die has laterally spaced projections, the projections on one of the dies being opposite the space between the projections on the other die. Each of the dies also has a stripper positioned in the spaces between the projections of the die. One of the dies is moved toward the other die to form the corrugations in the double reverse corrugated material. One die is moved away from the other die while the other die and both strippers are maintained substantially fixed with respect to each other. The stripper associated with the one die is moved with respect to the other die. The stripper associated with the other die is then moved with respect to the other die to strip the formed double reverse corrugated material from the other die. The formed material is then moved out from between the dies.

Preferably, the method comprises the steps of feeding the sheet metal material between an upper die and a lower die, each of the dies having a stripper positioned in the spaces between the projections of the associated die. Both strippers are connected to the upper die. The upper die is lowered with respect to the lower die, the lower stripper is lowered with respect to the lower die, and the upper stripper is raised with respect to the upper die, to form the corrugations in the double reverse corrugated material. The upper die is raised with respect to the lower die and both strippers, while maintaining the lower die in both strippers substantially fixed with respect to each other. The upper stripper is then raised with respect to the lower die by further raising the upper die. The lower stripper is raised with respect to the lower die by further raising the upper die to strip the formed double reversed corrugated material from the lower die. The formed material is then moved out from between the dies.

DETAILED DESCRIPTION OF THE PREFERRED EMBODIMENT

Figure 1:
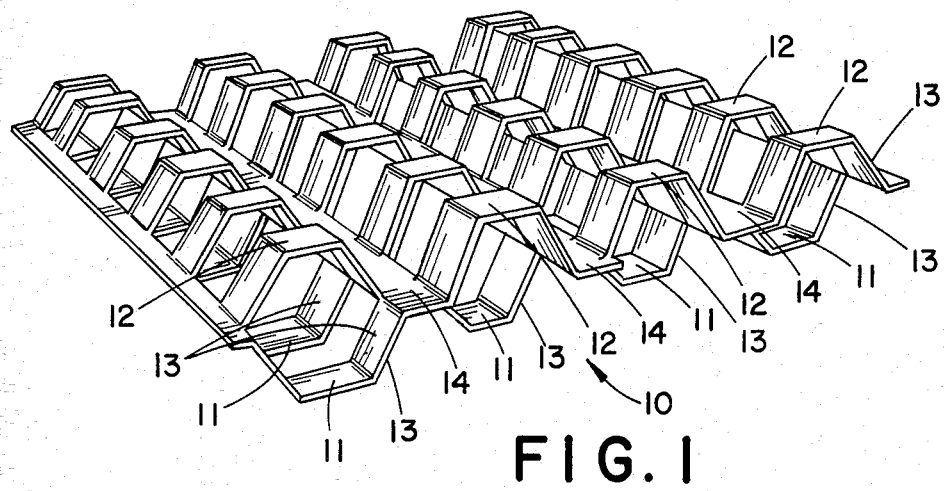
FIG. 1 is a perspective view of the double reverse corrugated material formed in accordance with the present invention.

Referring more particularly to FIG. 1, there is shown the double reverse corrugated material 10 formed in accordance with the present invention. The material 10 is generally similar to that disclosed in U.S. Pat. No. 3,376,684, issued to D. W. Cole, et al., which is incorporated herein by reference. The material includes a plurality of upper nodes 11 lying and defining a discontinuous planar surface above and parallel to the median plane of the material, and a plurality of lower nodes 12 lying in and defining a discontinuous planar surface parallel to the median plane and the plane of the upper nodes 11. Each of the upper and lower nodes 11 and 12 is connected to the median plane of the material by truss elements or web portions 13. Each of the truss portions 13 are connected together along transversely extending median strips 14 which extend generally perpendicularly to the truss portions 13. As will be noted in FIG. 1, the rows of upper and lower nodes 11 and 12 are symetrically staggered or offset so that the upper node 11 in one row extends longitudinally between the upper and lower nodes of the next adjacent row. This configuration prevents the slots which are formed between the upper and lower nodes from being continuous throughout the material causing the material to lose substantial strength.

Figure 4:
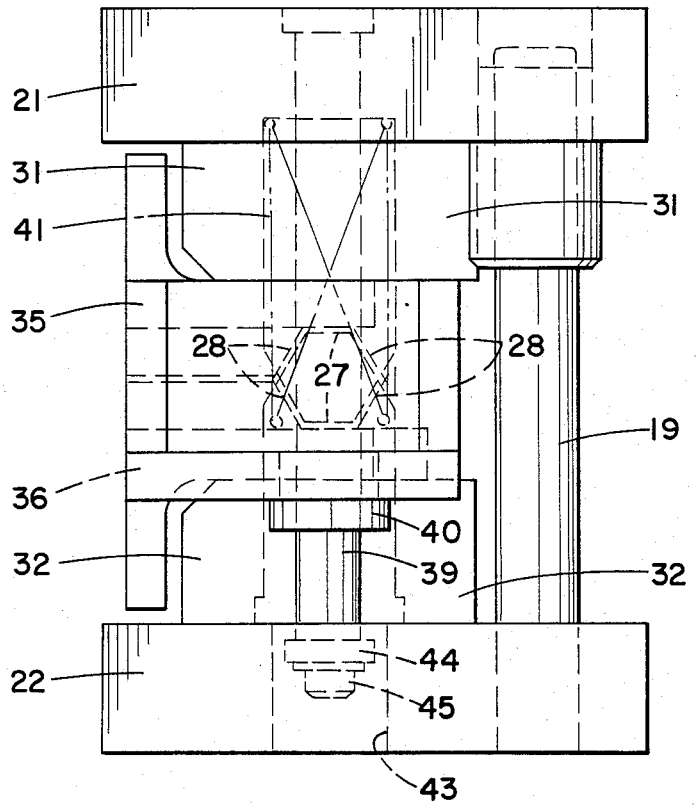
FIG. 4 is a side elevational view of the die of FIGS. 2 and 3.
Figure 3:
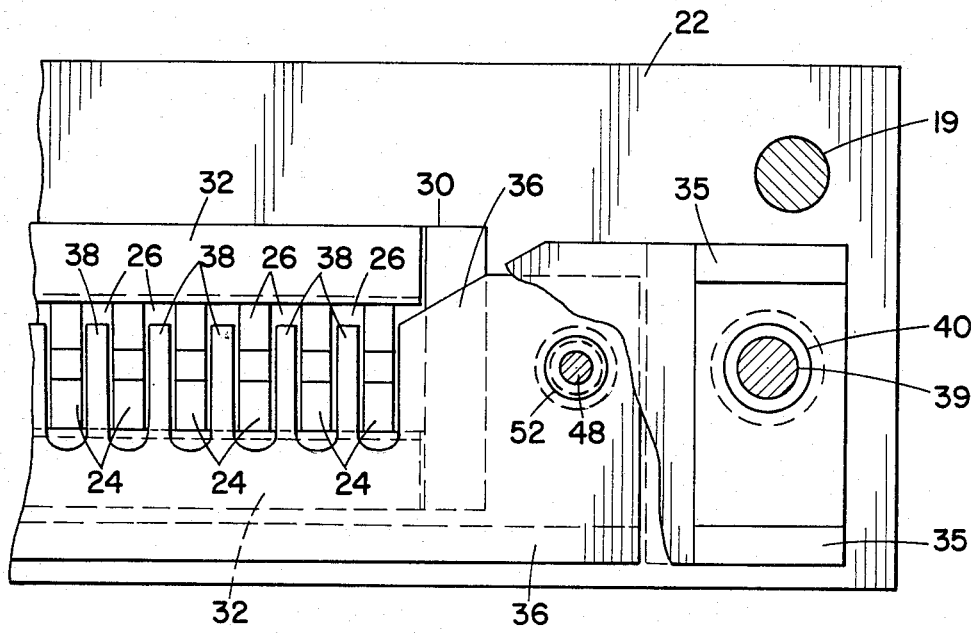
FIG. 3 is a top plan view in section of the die in FIG. 2.
Figure 2:
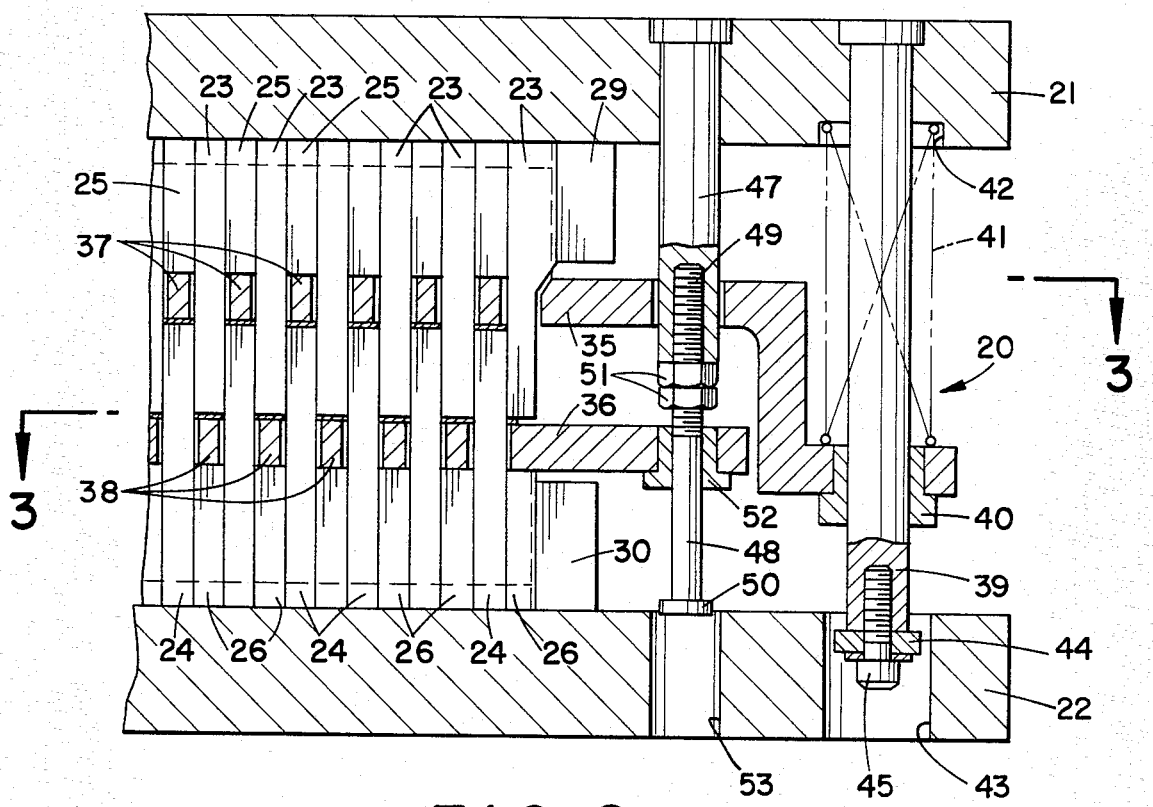
FIG. 2 is a front elevational view in section of the die used for forming the double reverse corrugated material in accordance with this invention.

In accordance with the present invention, the material 10 is formed using a die assembly 20 as shown in FIGS. 2–4. FIGS. 2–4 show the attachment of the elements at one end of the die assembly 20. It is understood that the opposite end of the die assembly is the mirror image of the construction shown in FIGS. 2–4. Since the attachment of the various elements is the same at each end of the die assembly, the attachments at both ends will be described with respect to the attachment at the end shown in FIG. 2–4. The die assembly 20 is adapted to be mounted in a conventional sheet metal press brake in accordance with known means.

The die assembly 20 comprises an upper base 21 and a lower base 22 which are conventionally mounted on the upper and lower platens of the press brake. The upper and lower bases 21 and 22 are kept in aligned by a post 19 which extends upwardly from the lower base 22 and is journaled in the upper base 21. Attached to each of the bases 21 and 22 are a plurality of projections 23 and 24. The upper projections 23 are attached to the upper base 21 and extend downwardly. The upper projections 23 are separated by a plurality of spacers 25. The lower projections 24 are attached to the lower base 22 and extend upwardly and are separated by a plurality of spacers 26. As shown in FIG. 4, each of the projections 23 and 24 have a flattened forward surface 27 extending parallel to the median plane of the material and to the plane of the upper and lower nodes 11 and 12 (FIG. 1). Each of the projections 23 and 24 also has beveled portions 28 extending from the front and rear of the forward surface 27 which are used to form the truss portions 13 of FIG. 1. The projections 23 and the spacers 25 alternate along the face of the upper die, and the projections 24 and spacers 26 alternate along the face of the lower die as shown in FIG. 2. At each end of the alternating row of projections and spacers is an end block 29 or 30. Each upper end block 29 is secured to the upper base 21, and each lower end block 30 is secured to the lower end base 22. End rails 31 and 32 (FIG. 5) are also provided on each side of the die secured to the bases 21 and 22, respectively.

Strippers 35 and 36 are provided to assist in stripping the finished material 10 from the die. The upper stripper 35 is associated with the upper die and includes fingers 37 (FIG. 3) which extend in the space between the projections 23 beneath the spacers 25. The lower stripper 36 is essentially similar in construction to the upper stripper 35 with fingers 38 which extend within the space between the projections 24 above the spacers 26.

The upper stripper 35 is mounted at each end to the upper base 21 by means of an upper lift pin 39. Each pin 39 is secured to the upper base 21 and extends downwardly therefrom. A bushing 40, which is positioned in a hole in the end of the stripper 35, is mounted on the pin 39. A spring 41 is mounted on the pin 39 between the end of the upper stripper 35 and the upper base 21. The end of the upper base 21 has a recess 42 to maintain the spring 41 in position. An opening 43 is provided in the end of the lower base 22 as a clearance for the lower end of the pin 39. An end cap 44 is mounted on the end of the pin 39 by means of a bolt 45. As the pin 39 is raised, the end cap 44 engages the bottom of the bushing 42 to lift the upper stripper 35. As the upper base 21 is lowered, the upper stripper 35 continues to be supported by the bushing 42 resting on the end cap 44 until the upper stripper engages the top of the lower projections 24. After the upper stripper 35 engages the lower projections 24, the spring 41 compresses as the upper base 21 continues to be lowered. The spring 41 urges the upper stripper 35 down upon the lower projections 24, so that as the upper base 21 is raised, the upper stripper 35 continues to be urged down upon the lower projections 24 while the upper projections 23 are raised along with the upper base 21.

The lower stripper 36 is connected at each end to the upper base 21 by means of a lower lift pin 47. Each lower lift pin 47, like the upper lift pins 39, is connected to the upper base 21. A stud 48, having a threaded portion 49 on one end and an enlarged head 50 on the other end, is connected to the bottom of the pin 47 by engagement of the threaded portion into a corresponding threaded bore in the bottom of the pin 47. A pair of lock nuts 51 secure the stud 48 to the lower lift pin 47. A bushing 52, which is mounted on the stud 48, is located in a hole at the end of the lower stripper 36. The lower stripper 36 thus rides on the stud 48 connected to the lower lift pin 47. As the upper base 21 is raised, the bushing 52 engages the head 50 on the stud 48, and the lower stripper 36 is raised with the upper base 21 when the upper base 21 is raised sufficiently above the lower base 22. As the upper base 21 is lowered, the lower stripper 36 engages the spacers 26 between the lower projections 24, and the lower stripper rests on the spacers as the lower base 22 continues to be lowered and the bushing 52 rides on the stud 48. An opening 53 is provided in the lower base 22 to provide a clearance for the stud 48.

While six upper projections 23 and six lower projections 24 are shown in FIGS. 2 and 3, it is understood that these are representative of a plurality of projections and that as many projections as desired may be provided in order to form double reverse corrugated material of any desired width.

Figure 5:
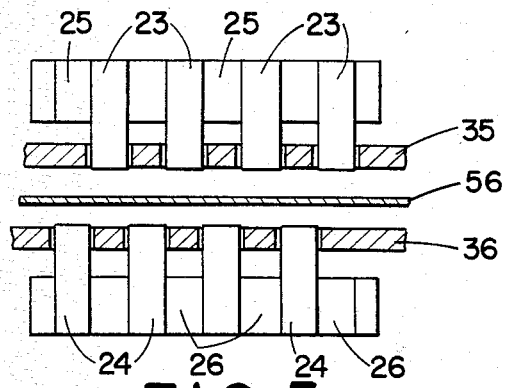
FIGS. 5–11 are front elevational views in section similar to a portion of FIG. 2 showing a sequence of operations in the method of the present invention.

The method of the present invention can be understood more fully with reference to the sequence of views in FIGS. 5–11. FIG. 5 shows the die fully opened with the upper projections 23 spaced from the lower projections 24. The lower stripper 36 is supported on the head 50 of the stud 48 connected to the lower lift pin 47, so that the lower stripper is raised above the lower spacers 26 and the top of the lower stripper 36 is approximately even with the top of the lower projections 24. The upper stripper 35 rests on the end cap 44 of the upper lift pin 39 and is supported in a position spaced apart from the upper spacers 25 and from the lower projections 24, so that the lower surface of the upper stripper 35 is approximately even with the bottom surface of the upper projections 23. Flat sheet metal stock material 56 is fed between the upper and lower dies.

Figure 6:
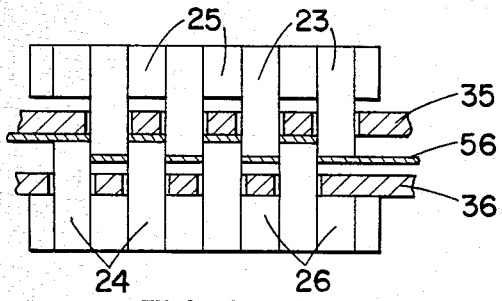

In FIG. 6, the upper base 21 has begun to be lowered. The upper projections 23 have engaged the space between the lower projections 24, and the lower projections 24 have engaged the space between the upper projections 23. The upper stripper 35 rests on the upper surface of the lower projections 23. The lower stripper 36 rests on the top of the lower spacers 26. As the projections 23 and 24 intermesh, they cut the stock material 56 to provide the openings between the upper nodes 11 and the lower nodes 12 (see FIG. 1).

Figure 7:
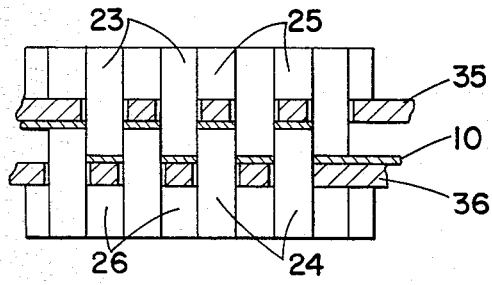

In FIG. 7, the upper base 21 has been lowered to its lowermost position and the dies are fully closed. The upper projections 23 engage the lower stripper 36, and the lower projections 24 engage the upper stripper 35. The double reverse corrugated material 10 has been formed from the sheet metal stock material at this point.

Figure 8:
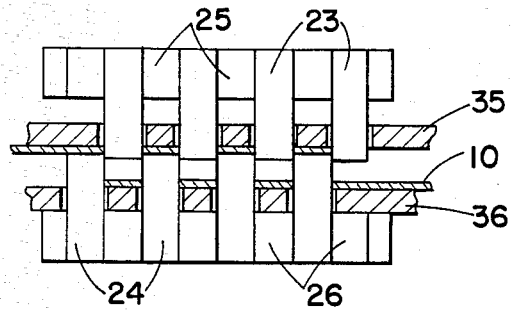

In FIG. 8, the upper base 21 has begun to be raised. The upper stripper 35 remains in its lowermost position with the bottom of the upper stripper 35 engaging the top of the lower projections 24 with the material 10 therebetween. The spring 41 ensures that the upper stripper 35 will remain against the formed material 10 as the upper projections 23 are pulled upwardly by the upward motion of the upper base 21. The upper stripper 35 thus holds the material 10 in place while permitting the retraction of the upper projections 23 from the newly formed lower nodes 12.

Figure 9:
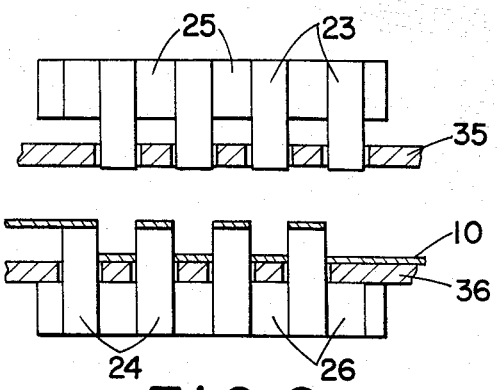

After the upper projections 23 have been fully retracted, the ends of the upper stripper 35 engage the end caps 44 on the upper lift pins 39, and the upper stripper 35 is pulled upwardly with the upper projections 23 and the upper base 21, as shown in FIG. 9. The formed material 10 remains on the lower projections 24.

Figure 10:
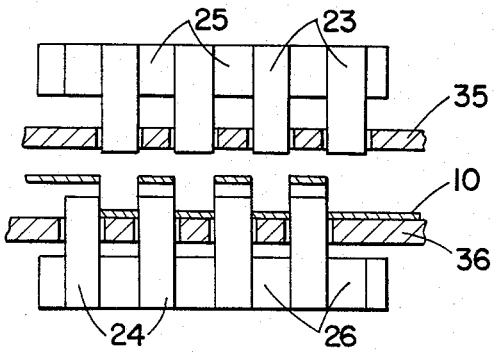

As the upper base 21 continues to move upwardly, the ends of the lower stripper 36 engage the heads 50 of the lower lift pins 47, and the lower stripper 36 is pulled upwardly with the upper base 21, as shown in FIG. 10. As the lower stripper 36 is raised, it pulls the formed material 10 upwardly with it and disengages the newly formed upper nodes 11 in the material from the lower projections 24.

Figure 11:
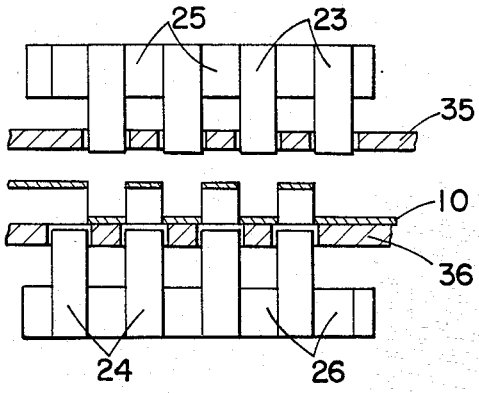

Finally, as shown in FIG. 11, the upper base 21 is fully raised and the formed material 10 has been completely removed from the projections 23 and 24 and is ready to be moved out from between the dies. At this point, the stock material is moved laterally a distance of one-half of the width of the projections 23 and 24 in order to offset the next row of nodes 11 and 12 as shown in FIG. 1. Suitable feed mechanisms are available which can perform the necessary lateral movement of the stock material as it is fed into the press brake along with the required longitudinal movement every time the dies are opened, so that the material can be formed substantially automatically using the method of the present invention.

As can be seen, the attachment of the strippers 35 and 36 to the upper die base 21 provides automatic stripping action to strip the formed material from the projections 23 and 24 as the upper base 21 is raised, so that manual stripping is not necessary. The material is substantially automatically formed with a minimum of operator supervision and at a high rate of production.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A method of making double reverse corrugated material which comprises the steps of:

(a) feeding sheet metal material between two opposed dies, each die having laterally spaced projections, the projections on one of the dies being opposite the space between the projections on the other of the dies, each of the dies also having a stripper positioned in the spaces between the projections of the die;

(b) moving one die toward the other die to form the corrugations in the double reverse corrugated material;

(c) moving one die away from the other die while maintaining said other die and both strippers substantially fixed with respect to each other;

(d) moving the stripper associated with said one die with respect to said other die;

(e) after step (d) and after the formed doubled reverse corrugated material has been stripped from said one die and before the double reverse corrugated material has been stripped from said other die, moving the stripper associated with said other die with respect to said other die to strip the formed double reverse corrugated material from said other die; and (f) moving the formed material out from between the dies.

2. A method of making double reverse corrugated material as defined in claim 1 wherein said one die is the upper die and said other die is the lower die.

3. A method of making double reverse corrugated material as defined in claim 1 comprising the additional step of laterally moving the sheet material one-half the width of the projections prior to feeding the sheet metal material between the dies.

4. A method of making double reverse corrugated material as defined in claim 1 wherein the formed material is moved from between the dies at the same time that additional sheet material is fed between the dies.

5. A method of making double reverse corrugated material which comprises the steps of:

feeding sheet metal material between an upper die and a lower die, the upper and lower dies each having laterally spaced projections, the projections on one of the dies being opposite the space between the projections on the other die, each of the dies having a stripper positioned in the spaces between the projections of the die, each of the strippers being connected to the upper die;

lowering the upper die with respect to the lower die to form the corrugations in the double reverse corrugated material;

raising the upper die with respect to the lower die and both strippers while maintaining the lower die and both strippers substantially fixed with respect to each other;

raising the upper stripper with respect to the lower die by further raising the upper die;

after raising the upper stripper to a position where the formed double reverse corrugated material has been stripped from the upper die and before the double reverse corrugated material has been stripped from said lower die, raising the lower stripper with respect to the lower die by further raising the upper die to strip the formed double reverse corrugated material from the lower die; and moving the formed material out between the dies.

6. A method of making double reverse corrugated material as defined in claim 5 wherein the lower stripper is lowered with respect to the lower die and the upper stripper is raised with respect to the upper die when the upper die is lowered with respect to the lower die.

7. A method of making double reverse corrugated material as defined in claim 5 comprising the additional step of laterally moving the sheet material one-half the width of the projections prior to feeding the sheet metal material between the dies.

8. A method of making double reverse corrugated material as defined in claim 5 wherein the formed material is moved from between the dies at the same time that additional sheet material is fed between the dies.

9. A method of making double reverse corrugated material as defined in claim 5 wherein the upper stripper is urged downwardly with respect to the upper die while being connected thereto to maintain the upper stripper substantially fixed with respect to the lower stripper and the lower die while the upper die is raised and to allow the upper stripper to be raised with respect to the lower die when the upper die is raised an additional amount.

10. A die for making double reverse corrugated material which comprises an upper die having laterally spaced projections;

a lower die having laterally spaced projections which oppose the spaces between the projections on the upper die;

an upper stripper positioned in the spaces between the projections of the upper die and connected to the upper die to move upwardly when the upper die has moved a predetermined distance away from the lower die;

spring means for urging the upper stripper away from the upper die to allow the upper stripper to be substantially fixed with respect to the lower die when the upper die is initially moved away from the lower die; and a lower stripper positioned in the spaces between the projections of the lower die, the lower stripper being connected directly to the upper die to move upwardly with respect to the lower die independently of the upper stripper when the upper die has moved a predetermined substantial distance away from the lower die to allow the lower stripper to be raised with respect to the lower die to strip the formed material from the lower die.

* * * * *